US006641715B1

(12) United States Patent
Gauthier

(10) Patent No.: US 6,641,715 B1
(45) Date of Patent: Nov. 4, 2003

(54) METHOD AND DEVICE FOR CATALYTIC CRACKING COMPRISING REACTORS WITH DESCENDING AND ASCENDING FLOWS

(75) Inventor: Thierry Gauthier, Brignais (FR)

(73) Assignee: Institut Francais du Petrole, Cedex (FR)

( * ) Notice: Subject to any disclaimer, the term of this patent is extended or adjusted under 35 U.S.C. 154(b) by 0 days.

(21) Appl. No.: 09/831,659

(22) PCT Filed: Nov. 12, 1999

(86) PCT No.: PCT/FR99/02801

§ 371 (c)(1),
(2), (4) Date: Jul. 13, 2001

(87) PCT Pub. No.: WO00/29508

PCT Pub. Date: May 25, 2000

(30) Foreign Application Priority Data

Nov. 13, 1998 (FR) ..... 98 14319

(51) Int. Cl.[7] ..... C10G 51/06; C10G 51/02; B01J 19/00

(52) U.S. Cl. ..... 208/78; 208/67; 208/72; 208/74; 208/75; 422/144; 422/145; 422/241

(58) Field of Search ..... 208/67, 72, 74, 208/75, 78; 422/144, 145, 241

(56) References Cited

U.S. PATENT DOCUMENTS 3,902,856 A * 9/1975 Burroughs et al. ..... 422/49
4,385,985 A * 5/1983 Gross et al. ..... 208/113
4,424,116 A 1/1984 Hettinger ..... 208/120.35
4,606,810 A 8/1986 Krambeck et al. ..... 208/74
5,039,395 A 8/1991 Martin et al. ..... 208/127
5,344,554 A * 9/1994 Pontier et al. ..... 208/164
5,498,326 A * 3/1996 Galtier et al. ..... 208/74
5,660,716 A * 8/1997 Bourgogne et al. ..... 208/163
5,997,726 A * 12/1999 Fersing et al. ..... 208/113
2002/0096452 A1 * 7/2002 Espeillac et al. ..... 208/67

FOREIGN PATENT DOCUMENTS

EP 573316 12/1993

* cited by examiner

*Primary Examiner*—Walter D. Griffin
(74) *Attorney, Agent, or Firm*—Millen, White, Zelano, Branigan, P.C.

(57) ABSTRACT

An entrained bed or fluidised bed process for catalytic cracking of a hydrocarbon feed in two reaction zones is described, one zone (1) being in catalyst dropper mode, the other (2) being in catalyst riser mode. A feed (102) and catalyst from at least one regeneration zone (302) are introduced into the upper portion of the dropper zone, the feed and catalyst are circulated in accordance with a catalyst to feed weight ratio, C/O, of 5 to 20, the cracked gases are separated from the coked catalyst in a first separation zone (105), the cracked gases are recovered (107), the coked catalyst is introduced (110) into the lower portion of the riser zone (2), the coked catalyst and said feed are circulated in a C/O weight ratio of 4 to 8, the used catalyst is separated from the effluent produced in a second separation zone (203), the catalyst is stripped in a stripping zone (212), the effluent and stripping gases are recovered (206) and the used catalyst is recycled (7) to the regeneration zone.

18 Claims, 2 Drawing Sheets

3
7
6
8
16
15
4
1
5
2
9
14
13
12
11
10

307
308
206
207
205
302
203
304
305
303
3
204
211
309
212
306
7
101
102
107
103
106
104
108
201
2
1
105
301
202
304
109
111
110

METHOD AND DEVICE FOR CATALYTIC CRACKING COMPRISING REACTORS WITH DESCENDING AND ASCENDING FLOWS

The present invention relates to a process and apparatus for catalytic cracking of hydrocarbon feeds.

The petroleum industry routinely employs cracking processes in which hydrocarbon molecules with a high molecular weight and boiling point are split into smaller molecules with a lower boiling point.

In recent catalytic cracking processes such as that described in European patent EP-A-0 291 253, the cracking reaction takes place in an elongate vessel with a substantially circular cross section, the catalyst being admitted into the lower portion of the vessel along with the atomised hydrocarbon feed. Bringing the feed into contact with the hot catalyst vaporises the hydrocarbons, entraining the catalyst towards the upper portion of the reaction zone, with the introduction of an entrainment fluid assisting the upward movement. The products formed during the reaction have a very broad range of boiling points. In general, the products formed are distinguished by their boiling point and chemical nature:

| | |
|---|---|
| Dry gases | $H_2$, $H_2S$, molecules containing 1 or 2 carbon atoms |
| LPG (liquid petroleum gas) | Molecules containing 3 or 4 carbon atoms |
| Gasoline | Molecules containing at least 5 carbon atoms with a boiling point of less than 220° C. |
| LCO (light cycle oil) | Molecules with a boiling point of more than 220° C. and less than 360° C. |
| Slurry | Molecules with a boiling point of more than 360° C. |
| Coke | Heavy molecules (generally polyaromatics remaining adsorbed on the catalyst after the reaction) |

The boiling points delimiting the cuts are given by way of indication and correspond to generally accepted standard values. Those cut points can vary depending on the refiner's needs, and in some cases can also produce intermediate cuts from the products formed.

The yields that are generally obtained naturally depend on the quality of the treated feeds. Typically, by way of indication, the yields observed (as a % by weight of the feed) for units are:

| | |
|---|---|
| dry gas | 1–5% |
| LPG | 10–25% |
| gasoline | 30–55% |
| LCO | 15–25% |
| slurry | 5–20% |
| coke | 3–10% |

In general, the coke formed is burned in one or more vessels termed regenerators towards which the catalyst circulates from the reactor outlet. The heat produced by combustion of the coke re-heats the catalyst, which is then re-introduced into the reactor inlet and brought into contact with the feed. The catalytic cracking process is an adiabatic process. The heat recovered by the catalyst during its passage into the regeneration zone is equal to the heat lost by the catalyst during its passage through the reaction zone. This constrains the operator to employ operating conditions that are not independent of each other. The operating conditions that most affect the yields and selectivities for a given reactor are essentially the catalyst flow rate, which is generally related to the feed flow rate by the term C/O (C for catalyst, and O for oil). The normal range for operating catalytic cracking units is generally:

C/O=4–8 (C/O=weight ratio of catalyst flow rate to feed flow rate);

T (at reactor head)=500–550° C.

Conversion is known to increase with temperature and C/O. However, using conventional techniques, that increase can, inter alia, be accompanied by a significant increase in the coke and dry gas yields. Increasing the coke yield by means of the regenerator-reactor thermal balance and dimensions of the unit frequently limits the operator to a restricted range of operating conditions and, for a given feed type, to a fairly fixed yield structure.

The sale price of different products can fluctuate with time, which may tempt the refiner to decide to maximise certain products to the detriment of some others. Further, the change in specifications imposed on the products in different states means that certain FCC products may no longer have an outlet (for example, LCO is highly aromatic and has a very poor cetane index, so its use in certain fuels in the gas oil pool poses a problem; the sulphur content of heavy gasoline (160° C.–220° C.) renders its use in gasoline pools difficult in some cases). It may thus be advantageous to minimise certain cuts as well.

Maximising propylene, a product with a high added value (molecule included in the LPG cut) is known to involve making the reaction conditions more severe (higher temperature, higher C/O). At the same time, making the conditions more severe means that the yields of other cuts (LCO and gasoline) decreases.

Mild conditions tend to maximise the LCO, which may be advantageous in states in which middle distillates are in great demand in the fuel market, but LPG (including propylene) and gasoline will probably not be maximised.

Thus, the operation of the reaction zone for a conventional unit is not always compatible with achieving the two aims such as the following non-limiting examples:

maximising propylene and LCO;

minimising heavy gasoline, maximising light gasoline.

There is thus a need for solutions that can enable the reaction zone to operate both under severe and mild conditions, for example using two reaction zones operating under different operating conditions.

The reaction zones generally used in the majority of catalytic cracking units in current use readily allow operations to be carried out under mild cracking conditions (C/O of 4 to 8 and reactor outlet temperatures of 500° C. to 550° C.). The residence time for the hydrocarbons in that reaction zone, the minimum constitution of which is a tube with a substantially circular cross section and elongate form in which the fluids flow in an overall bottom to top direction, usually termed a riser, and a system for separating the cracked vapours and the catalyst, is generally more than 2 seconds (s), of the order of about 2 s to about 10 s. The residence time for the hydrocarbons in contact with the catalyst is usually more than 1 s.

Juxtaposing two conventional reactors to obtain two types of operating conditions in the same catalytic cracking unit such as that described by Niccum, P. K., Miller, R. B., Claude A. and M. A. Silvermann in "Maxofin: a novel FCC process for maximizing light olefins using a new generation ZSM5 additive" (1998, NPRA annual meeting, San Francisco, Calif., USA, Mar. 16$^{th}$, 1998), renders necessary the use of additives in the second riser where the reaction is carried out under more severe conditions to obtain a more favourable selectivity. Further, the more severe conditions in the second reactor cause a very large increase in the coke yield (more than 2% with respect to the feed). The arrangement of that type of system is thus not optimal.

The prior art is also illustrated by U.S. Pat. Nos. 4,424,116 and 4,606,810, which describe a concatenation of two riser reactors in series. U.S. Pat. No. 5,039,395 also illustrates the prior art.

In order to minimise a cut, with a unit possessing one or more conventional riser type vessels, it is also possible to recycle the products the production of which is to be minimised to the riser, in the case of heavy feeds, this has a huge advantage for the thermal balance of the units: vaporising the recycle consumes more heat and thus produces more heat in the regeneration zone and thus more coke in the reaction zone; further, since it is cleverly located downstream with respect to fresh feed injection, injection of the recycle encourages fresh feed vaporisation which then enables even heavier feeds to be treated (with higher median boiling points and end points). Such an apparatus has, for example, been described in French patent FR A-2 621 322 for cracking heavy cuts.

In that type of implementation, the recycled products are not exposed to very severe conditions and react only slightly. The aim of the recycles has more to do with the thermal balance and vaporising the feed than degrading the recycle into higher added value products.

It is also possible to use a recycle upstream of the feed, to expose the recycle to conditions that are more severe than those for the feed. Under those conditions, the products formed under the most severe conditions have the time to degrade above the feed injection where the residence time in contact with the catalyst is necessarily quite long (more than 1–2 s).

In order to operate under more severe operating conditions, it is preferable to use shorter hydrocarbon residence times in the reactor. By increasing the temperature, thermal degradation of the products becomes increasingly important. To limit their impact, the residence time in the hydrocarbons under such conditions must be limited. Further, the residence time is short and still further, the mechanisms controlling contact between the hydrocarbons and catalyst must be properly controlled along with the hydrodynamics of the reactor. The riser reactor combined with a suitable mixing system such as that described in International patent application WO/FR98/122279, can optimise the selectivities for higher value products (LPG, gasolines) by minimising the zero value products (minimal increase in coking compared with a conventional reactor, but under very different temperature and C/O conditions, a reduction of about 30% in dry gases compared with conventional technology) and maximising conversion, thanks to the production of very severe conditions.

It can thus be envisaged, in order to increase the flexibility of the FCC operation, to provide a concatenation of a dropper reactor with a riser reactor. However, according to EP-B-0 573 316 describing that apparatus, all the products exposed to the riser reactor must then be passed into the riser reactor. The residence time for the products formed in the dropper reactor is thus prolonged by the that for passage through the riser reactor. Further, it is not suggested that these two reactors could be operated under significantly different operating conditions.

The essential advantage of this type of apparatus is to be able to bring the catalyst and feed into contact in an optimal manner due to the initial use of a dropper reactor.

When carried out correctly and when the contact time between the catalyst and the hydrocarbons is limited, bringing hydrocarbons into contact with the catalyst in a dropper reactor can minimise the quantity of coke formed. This results in a much lower quantity of coke on the catalyst than in the equivalent riser reactor. Combined with suitable operating conditions (higher circulation rate for the catalyst compared with the same quantity of feed), meaning that the quantity of coke on the catalyst can be very significantly reduced, which is of particular advantage for heavy feeds which are known for their coking ability. Further, coke deposited on the catalyst tends to significantly deactivate the catalyst; the more coke, the more significant the deactivation. Typically, in conventional riser reactors, the quantity of coke present on the catalyst is between 0.7% and 1.5% by weight, depending on the feed treated, the catalyst, the operating conditions and the dimensions of the unit. Under such conditions, the residual activity of the catalyst is known to be low. It is thus foolish to wish to re-introduce the catalyst into a new reaction vessel. In contrast, in the case of a dropper reactor, it is possible to limit the quantity of coking on the catalyst to values of about 0.2–0.5% by weight depending on the operating conditions, solution its residual activity remains high. Under such conditions, the catalyst from the dropper reactor can advantageously be introduced into a reaction chamber such as a riser, optionally mixed with a flow of regenerated catalyst (i.e., directly issuing from the regeneration chamber). It can thus be seen that a concatenation of reaction zones that are initially in dropper mode, then in riser mode can readily be envisaged where the catalyst from the dropper reaction zone is re-introduced in its entirety into the inlet to the riser reactor.

The aim of the present invention is to remedy the omissions of the prior art by proposing a concatenation of distinct reaction zones that can operated under very different temperature and C/O conditions. More precisely, the invention concerns a catalytic cracking process composed of a reaction zone with at least two reactors, at least one of said reactors having an overall downward flow of fluids and catalyst (dropper reactor) and at least one of said reactors having an overall upward flow of fluid and catalyst (riser reactor), said reactors being characterized in that in each reactor, the hydrocarbons introduced into the reactor are brought into contact with hot catalyst to vaporise said hydrocarbons if they are introduced in the liquid form, said vaporised hydrocarbons then reacting in the presence of the catalyst, the reacted hydrocarbons then being separated from the catalyst using separation means (inertial separators and/or cyclones) and leaving the reaction zone to undergo routine downstream treatments (fractionation, . . . ). The reactors are also characterized in that the dropper reactor or reactors is/are followed by at least one riser reactor, all of the catalyst from the dropper reactor(s) passing into at least one downstream riser reactor.

More particularly, the invention provides an entrained bed or fluidised bed process for catalytic cracking of a hydrocarbon feed in two reaction zones, one zone in catalyst dropper mode, the other in catalyst riser mode, the process being characterized in that a feed and catalyst from at least one regeneration zone are introduced into the upper portion of the dropper zone, the feed and catalyst are circulated in said zone in a catalyst to feed, C/O, weight ratio of 5 to 20, the cracked gases and coked catalyst from the dropper zone are separated in a first separation zone, the cracked gases are recovered, the coked catalyst is introduced into the lower portion of the riser zone, a feed is introduced into the lower portion of said riser zone, the coked catalyst and said feed are circulated in a C/O weight ratio of 4 to 8, the used catalyst is separated from the effluent produced in a second separation zone, the catalyst is stripped using a stripping gas in a stripping zone, the effluent and stripping gases are recovered and the used catalyst is recycled to the regeneration zone where it is at least partially regenerated using a regeneration gas.

The residence time for the feed in the dropper and riser are respectively generally 50 to 650 ms in the dropper and 600 to 3000 ms in the riser, preferably 100 to 500 ms in the dropper and 1000 to 2500 ms in the riser. The residence time is defined as the ratio of the volume of each of the reaction vessels (riser or dropper) with respect to the volume flow rate of the gaseous effluents in each chamber under the outlet conditions.

According to one characteristic of the process, the used catalyst is regenerated in two superimposed regeneration zones, the used catalyst to be regenerated being introduced into a first lower regeneration zone, the at least partially regenerated catalyst being sent to the second, upper regeneration zone and the regenerated catalyst from the upper regeneration zone being introduced into the dropper reactor.

The catalyst to oil (C/O) ratio is advantageously in the range 7 to 15 for the dropper reactor and in the range 5 to 7 for the riser reactor.

The temperature of the catalyst at the dropper outlet is generally higher than that at the riser outlet. It can be 500° C. to 700° C., advantageously 550° C. to 600° C., while that of the catalyst at the riser outlet can be in the range 500° C. to 550° C., advantageously 515° C. to 530° C. These temperatures are strictly dependent on the respective values of C/O, the C/O ratio of the dropper being higher than that of the riser.

According to a characteristic of the process, the feed supplying each of the reactors can either be a fresh feed, or a recycle of a portion of the products from downstream fractionation, or a mixture of the two.

Preferably, a fresh feed can be introduced into the riser reactor and at least a portion of the recycle can be introduced into the dropper reactor.

It may be advantageous to introduce the feed into the riser reactor above the point of introduction of the coked catalyst and the point of introduction of the regenerated catalyst.

The feed can be injected into each of the two reactors as a co-current or counter-current.

According to one characteristic of the process, the feed flow rate, for example the recycle, into the dropper reactor can represent less than 50% by weight of the feed flow rate to be converted circulating in the riser reactor.

The invention also concerns an apparatus for carrying out the process. It generally comprises:

- a first substantially vertical dropper reactor with an upper inlet and a lower outlet;
- a first means for supplying regenerated catalyst connected to at least one regenerator for used catalyst and connected to said upper inlet;
- a first means for supplying atomised feed disposed below the first catalyst supply means;
- a first vessel for separating catalyst from a gas phase connected to the lower outlet from the first dropper reactor and having an outlet for a gas phase and an outlet for coked catalyst;
- a second substantially vertical riser reactor having a lower inlet and an upper outlet;
- a second means for supplying catalyst connected to the outlet for coked catalyst from the first separation vessel and to the lower inlet to the second reactor;
- a second means for supplying feed located above the lower inlet into the second reactor;
- a second vessel for separating used catalyst from a second gas phase connected to said upper outlet from said second reactor, said second chamber comprising a catalyst stripping chamber and having an upper outlet for a gas phase and a lower outlet for used catalyst, said lower outlet being connected to the regenerator.

The invention will be better understood from the accompanying figures, in which.

Figure 1:
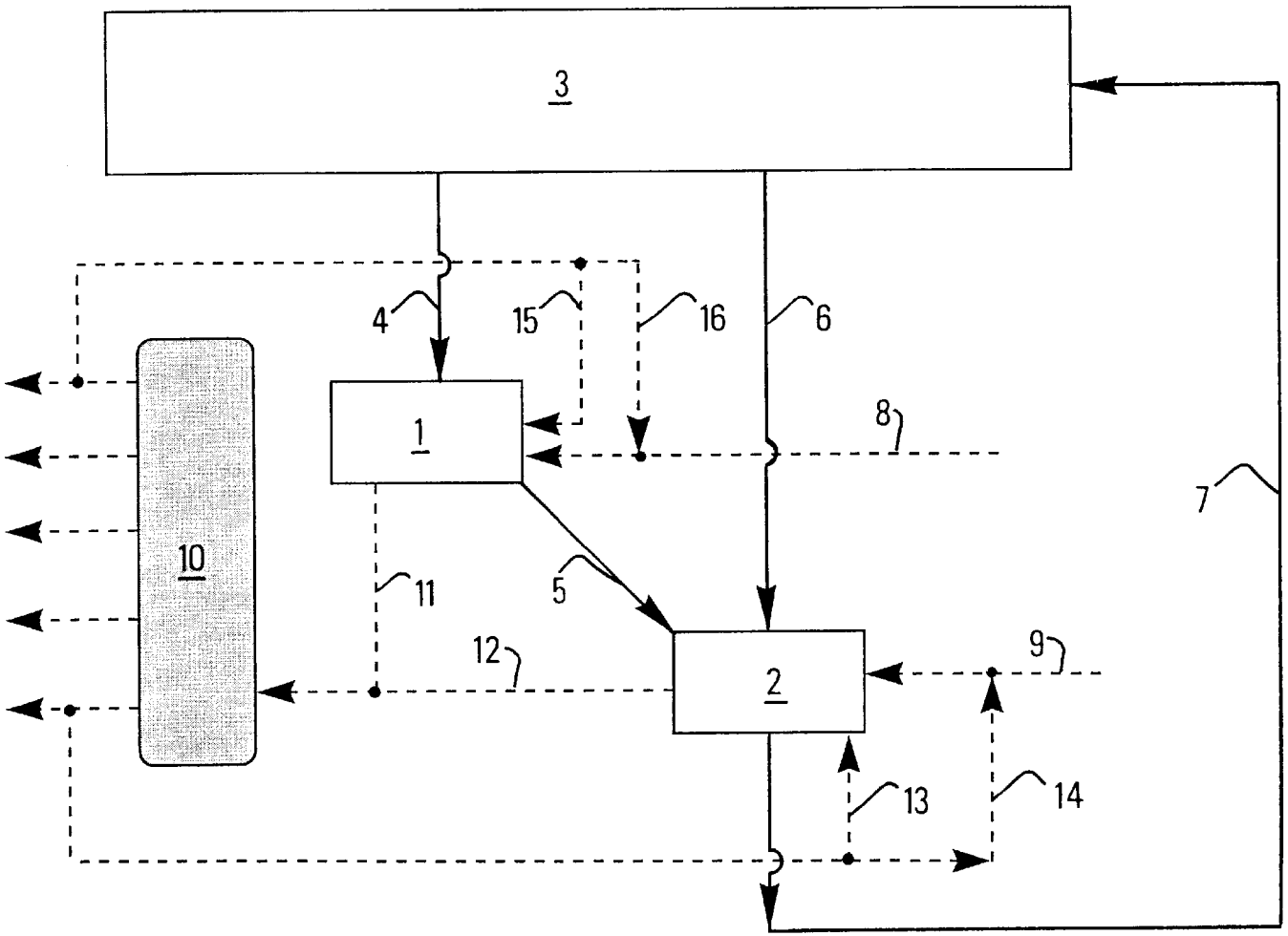
FIG. 1 is a diagrammatic representation of the process, the catalyst flow being shown as a solid line and the hydrocarbon flow being shown as a dotted line.

FIG. 1 shows the process under these conditions. Catalyst regenerated in a regeneration zone (3) is transported to the inlet to a reactor in overall dropper mode via transfer means (4), withdrawn from the dropper reactor by transport means (5) and introduced into a riser reactor (2) then, having traversed the riser reactor, transported via a line (7) to regeneration zone (3). The riser reactor can also be supplied with freshly regenerated catalyst via means (6) for transporting catalyst from the regeneration zone to the bottom of riser reactor (2). The feed supplying each of the reactors can either be a fresh feed (line (8) for the dropper reactor, line (9) for the riser reactor), or a recycle of a portion of the products from downstream fractionation (line (16) for the dropper reactor, line (14) for the riser reactor), or a mixture of the two. It is possible to introduce fractionation recycles into each reactor independently of the means for introducing fresh feed (line (15) for the dropper reactor, line (13) for the riser reactor). The gaseous effluents from each reactor are transported via lines (11) for the dropper reactor and line (12) for the riser reactor to a zone (10) for fractionating the different hydrocarbon cuts. FIG. 1 shows an arrangement in which fractionation is common to the two reaction vessels. However, it is also possible for fractionation to be independent for each reactor, which is advantageous if the operating conditions for the two reaction zones are very different. In that case, very different yield structures may economically justify the fractionation of effluents adapted to each of the reaction vessels.

It may be advantageous to cool at least a portion of the effluent produced from the dropper reactor downstream of the first separation and stripping zone, given the outlet temperature for that reactor, using a product from downstream fractionation or using at least a portion of the effluent from the riser reactor.

Figure 2:
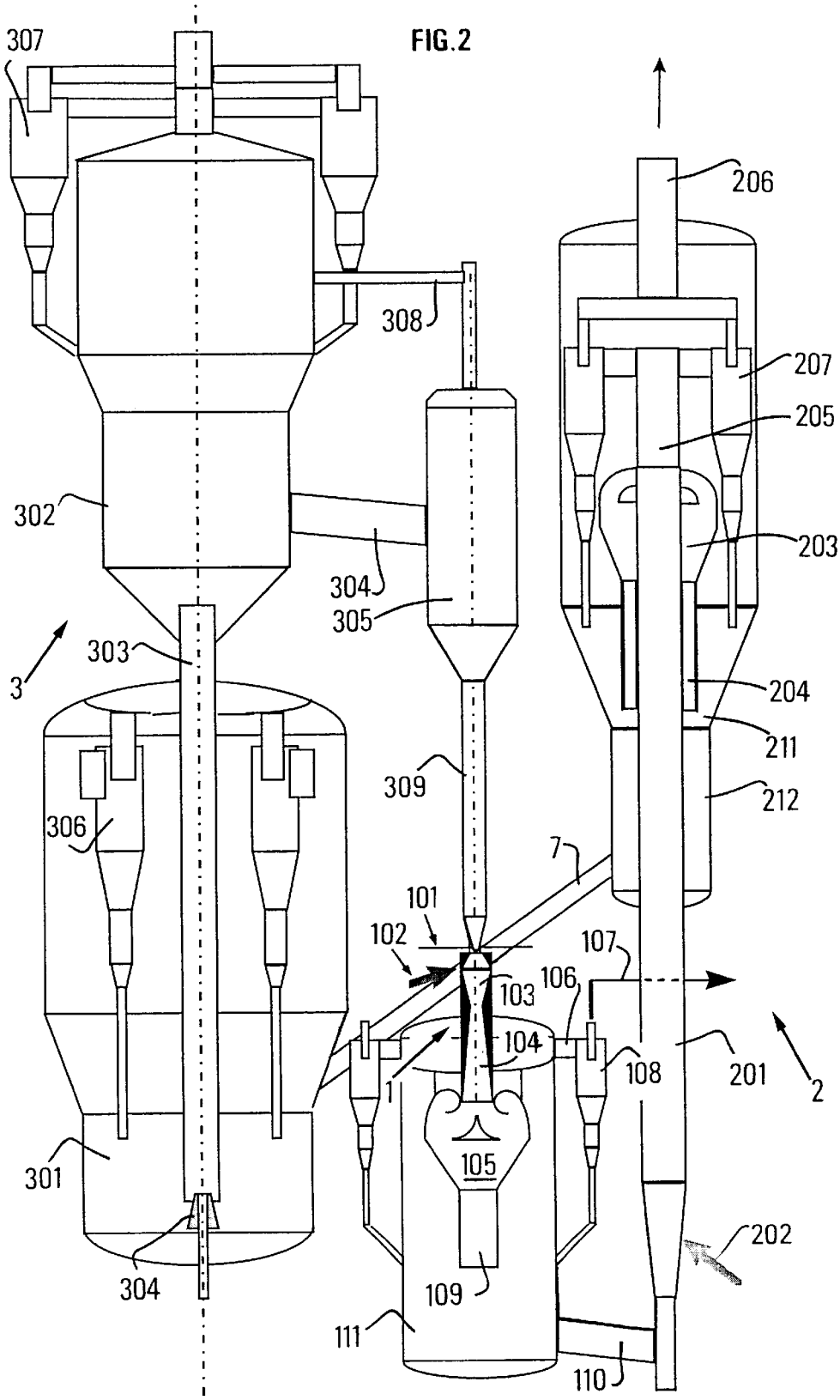
FIG. 2 is a schematic diagram of an apparatus comprising a dropper, an intermediate separator and a riser.

FIG. 2 describes a possible arrangement of the different constituents of the process of the invention. So that the catalyst can circulate properly between the different vessels, the pressures in each of the vessels must be compatible with the circulation rates of the catalyst and hydrocarbons desired for each of the vessels. In FIG. 2, a regeneration zone (3) is constituted by two vessels (301) and (302) in which the catalyst is regenerated as a fluidised bed, air being introduced into each vessel. The catalyst is transported between the two vessels using a lift (303), in which the gas introduced into the base has a velocity sufficient to transport the catalyst between the two vessels. This transport gas can be air. Typically, the proportion of air necessary for regeneration is 30% to 70% into vessel (301), 5% to 20% in lift (303) in order to transport the catalyst and 15% to 40% in vessel (302). Means (304) such as a plug type solids valve, can control the rate of circulation between the vessels (301) and (302). In each of the two vessels (301) and (302), the gaseous combustion effluents are dedusted by passage into separators such as cyclones, represented schematically (306)

and (307). The pressure in each vessel (301) and (302) can be controlled by valves located on lines for evacuating combustion effluents that are at least partially dedusted.

The catalyst is then transferred to the reaction zones. FIG. 2 shows a concatenation of two reaction zones, one being a dropper (1), and the other, downstream, being a riser (2). In this example, all of the catalyst circulating in reactor (2) also circulates in reactor (1). However, in some cases it may be advantageous to mix, at the riser (2) inlet, the catalyst from (1) with catalyst directly originating from regeneration vessel (3). By way of example, FIG. 2 shows how it is possible to transfer catalyst from one regeneration vessel (302) to reactor (1). The catalyst is withdrawn at the wall through an inclined line (304) at an angle generally in the range 30° to 70° with respect to the horizontal, guiding the catalyst to a vessel (305) in which the catalyst movement is slowed down to allow any gas bubbles to be evacuated to the regeneration vessel via an equilibration tube (308). The catalyst is then accelerated and drops via a transfer tube (309) to the reactor inlet. During its path from the regeneration vessel, the catalyst is maintained in a fluidised state by adding small amounts of gas throughout the transport route. If the catalyst is maintained in a fluid state, this can produce at the inlet to the reaction zone (1) a pressure that is higher than that of the fumes from the external cyclones (307). The reaction zone (1) defined as a dropper is generally constituted by means for introducing catalyst (101) which may be a solid valve, an orifice or simply the opening from a line, a contact zone (103) located below (101) where the catalyst meets a counter-current, for example the hydrocarbon feed introduced via means (102), generally constituted by atomisers where the feed is finely divided into droplets, generally helped by introducing auxiliary fluids such as steam. The means for introducing the catalyst are located above the means for introducing feed. Between the contact zone (103) and the means for separating hydrocarbons from the catalyst (105), it is possible to provide a reaction zone (104) that is substantially elongate, shown vertically in FIG. 2, although this position is not exclusive. The mean residence time for hydrocarbons in zones (103) and (104) is less than 650 ms, preferably in the range 50 to 500 ms. The effluents from the dropper are then separated in a separator (105) as described in French patent application FR-A-98/09672, hereby incorporated by reference, where the residence time must be limited to as short a time as possible. The gaseous effluents (cracked gas) from the separator can then undergo a supplemental dedusting step through external cyclones (108) disposed downstream on a line (106). The gaseous effluents (cracked gas) are evacuated via a line (107). It is also possible to chill the gaseous effluents, to limit thermal degradation of the products, for example by injecting liquid hydrocarbons into the effluent leaving cyclones (108) via line (107). The catalyst separated in separator (105) is then either re-injected directly into the base of a riser reactor (201) through a line (110), as shown in FIG. 2, or introduced into a fluidised bed (111) of a stripping feed through a line or opening (109). The catalyst in the fluidised bed (111) is then stripped (contact with a light gas such as steam, nitrogen, ammonia, hydrogen or even hydrocarbons with less than 3 carbon atoms (using means that have been described in the prior art)) before being transferred to the riser reaction zone (2) via line (110). The gaseous stripping effluents are generally evacuated from the fluidised bed (111) through the same means (106) and (108) for evacuating the gaseous effluents from the reaction zone (1) via line (107). All of the effluents can be chilled by quench means (not shown) on lines (106) or (107).

Reaction zone (2) is a substantially elongate tubular zone; numerous examples thereof have been described in the literature. In the example shown in FIG. 2, the hydrocarbon feed is introduced via means (202) generally constituted by atomisers where the feed is finely divided into droplets generally by introducing auxiliary fluids such as steam introduced into the base of the reactor. Means for introducing catalyst are located below the feed introduction means. In order that the reaction zone can be considered to be a riser zone, the feed has to be introduced above at least one catalyst inlet. In the case of FIG. 2, all of the catalyst from the dropper reactor and the feed introduction means are located above the line (110). In the opposite case, the riser reactor will be supplied by a plurality of catalyst streams, at least one thereof from a dropper reactor. It will then be possible to position the feed introduction means (202) above at least one catalyst supply (for example from the regeneration zone) and below at least one catalyst supply (for example from a dropper). The reaction then takes place in a tube reactor or riser (201). The riser effluents are then separated in a separator (203) such as that described in FIG. (2) of PCT application PCT/FR98/01866, hereby incorporated by reference. The catalyst from separation step (203) is then introduced into a fluidised bed (211) of a stripping chamber (212) via lines or openings (204). The catalyst in (211) is then stripped (contact with a light gas such as steam, nitrogen, ammonia, hydrogen or even hydrocarbons with less than 3 carbon atoms via means that are well known in the prior art) before being transferred to the regeneration zone (301) via lines (7). The gaseous reaction effluents separated in (203) are evacuated through a line (205) to a secondary separator (207) such as a cyclone before being directed to the fractionation section (10) via a line (206). The gaseous stripping effluents are generally evacuated from the fluidised bed (211) via the same means (206) that evacuated the gaseous effluents from reaction zone (2).

The coked catalyst is withdrawn from stripping chamber (212) and recycled to the first regeneration vessel (301) located below regeneration vessel (302).

By carefully disposing the vessels with respect to each other, it is possible to make the process function correctly while maintaining the effluents in line (106) and line (206) at the same pressure imposed downstream of the fractionation column without using a differential pressure control valve in lines (106) and (206).

By way of example and to illustrate the invention, the results obtained by an industrial unit provided with a conventional riser reactor (case A) treating a heavy feed and equipped with a double regeneration system as described in FIG. 2 are compared with the results which would be obtained by inserting a dropper upstream of this reactor in both cases. In the first case (case B), consider a concatenation of two reaction zones without separation of the hydrocarbon vapours at the outlet from the dropper. It is then necessary to inject all of the fresh feed into the inlet to the dropper. In the second case (case C), the dropper is supplied by the LCO cut produced by the riser reactor with separation of the hydrocarbon vapours at the outlet from the dropper while the riser is supplied with fresh feed. This allows complete decoupling of the operating conditions in these two reactors, and as can be seen in the overall dropper reactor+riser reactor yield structure compared with the fresh feed, can minimise the LCO yield to the advantage of the gasoline and LPG, which is much more advantageous than in the case of a concatenation such as that of case B. This change in selectivities is carried out with a slight increase in the production of dry gas and coke, which latter is minimised by using a short residence time dropper reactor.

It can also be seen that the recycle ratio in case C is substantially reduced to maintain the temperature of the catalyst and effluents at the riser outlet to a comparable value.

| | | Case A | Case B | Case C |
|---|---|---|---|---|
| FCCUF (unit feed) | Kg/s | 45.48 | 45.48 | 45.48 |
| C/O RR | (–) | 5.39 | 7 | 5.39 |
| T outlet RR | ° C. | 513 | 513 | 513 |
| Hydrocarbon recycle RR | % feed | 30.00 | 30.00 | 13.00 |
| T fresh feed RR | ° C. | 178.2 | | 178.2 |
| T recycle RR | ° C. | 175.4 | 175.4 | 175.4 |
| (air reg 1)/(total air) proportion | % | 70.25 | 70.25 | 70.25 |
| T REG1 | ° C. | 696 | 679 | 704 |
| T REG2 | ° C. | 775 | 743 | 787 |
| Air used for regeneration | t/h | 165 | 171.4 | 174 |
| C/O DR | (–) | — | 7 | 7 |
| T outlet DR | ° C. | — | 618 | 550 |
| T feed DR | ° C. | — | 178.2 | 150 |
| Yields | | | | |
| Dry gas | % FCCUF | 4.37 | 3.90 | 4.65 |
| Propane | % FCCUF | 1.49 | 1.42 | 1.63 |
| Propylene | % FCCUF | 4.25 | 4.22 | 4.68 |
| C4 cut | % FCCUF | 9.61 | 9.94 | 10.33 |
| Gasoline | % FCCUF | 41.34 | 42.96 | 46.49 |
| LCO | % FCCUF | 14.30 | 13.94 | 6.72 |
| Slurry | % FCCUF | 16.59 | 15.26 | 17.02 |
| Coke | % FCCUF | 8.06 | 8.36 | 8.49 |

The following abbreviations were used in the example:
RR = riser reactor
DR = dropper reactor
REG1 = first regeneration reactor
REG2 = second regeneration reactor
FCCUF = total fresh feed at inlet to FCC reactor
C/O = (catalyst/oil)
The properties of the hydrocarbon feed considered were as follows:
Density: $d_4^{15} = 0.934$
Sulphur content: % S = 0.5
Conradson carbon: 5.6

What is claimed is:

1. An entrained bed or fluidized bed process for catalytic cracking of hydrocarbons in two reaction zone, one zone (1) in catalyst dropper mode, the other (2) in catalyst riser mode, said process comprising:

introducing a first feed (102) and catalyst from at least one regeneration zone (302) into the upper portion of the dropper zone, circulating the feed and catalyst in said dropper zone in a catalyst to feed weight ratio, C/O, of 5 to 20, separating cracked gases and coked catalyst from said dropper zone in a first separation zone (105), recovering the cracked gases (107), introducing the coked catalyst into the lower portion of the riser zone, introducing a second feed (202) into the lower portion of said riser zone (2), circulating the coked catalyst and said feed in a C/O weight ratio of 4 to 8, separating used catalyst from the resultant effluent of said riser zone in a second separation zone (203), stripping the catalyst with a stripper gas in a stripping zone (212), recovering the effluent and stripping gases (206), and recycling the used catalyst (7) to the regeneration zone where it is at least partially regenerated with a regeneration gas to produce at least partially regenerated catalyst.

2. A process according to claim 1, in which the temperature at the outlet from the dropper zone is higher than at the outlet from the riser zone.

3. A process according to claim 1, in which the used catalyst is regenerated in two superimposed regeneration zones, the used catalyst to be regenerated being introduced into a first lower regeneration zone, the at least partially regenerated catalyst being sent to the second, upper regeneration zone and the regenerated catalyst from the upper regeneration zone being introduced into the dropper zone.

4. A process according to claim 1, in which the catalyst to oil (C/O) ratio is in the range 7 to 15 for the dropper zone and in the range 5 to 7 for the riser zone.

5. A process according to claim 1, in which the first feed and the second feed are each a fresh feed, a recycle of a portion of the products from downstream fractionation, or a mixture of the two.

6. A process according to claim 5, in which fresh feed is introduced into the riser zone and at least a portion of said recycle is introduced into the dropper zone.

7. A process according to claim 6, in which the fresh feed flow rate into the dropper zone represents less than 50% by weight of the flow rate of the feed to be converted in the riser zone.

8. A process according to claim 7, in which the fresh feed and any recycle passed into the dropper reactor represent less than 50% by weight of the feed to be converted in the riser reactor.

9. A process according to claim 1, in which the coked catalyst from the dropper zone is stripped with a gas after having been separated and before introduced into the riser zone, and the stripping gas is recovered.

10. A process according to claim 1, in which the riser zone is also supplied by regenerated catalyst.

11. A process according to claim 10, in which the second feed is introduced into said riser zone at a point between the point at which regenerated catalyst is introduced into said riser zone and the point at which coked catalyst is introduced into the riser zone.

12. A process according to claim 10, in which the second feed is introduced into said riser zone at a point above the point at which coked catalyst is introduced into said riser zone and the point at which regenerated catalyst is introduced into the riser zone.

13. An apparatus for fluidized bed or entrained bed catalytic cracking of hydrocarbon feed comprising:

a substantially vertical dropper reactor (1) with an upper inlet and a lower outlet;

a first means (101) for supplying regenerated catalyst connected to at least one regenerator for used catalyst and connected to said upper inlet;

a first means (102) for supplying atomized feed disposed below the first catalyst supply means;

a first separation vessel (105) for separating catalyst from a gas phase connected to the lower outlet from the first dropper reactor (1) and having an outlet (106) for gas phase and an outlet for coked catalyst;

a substantially vertical riser reactor (2) having a lower inlet and an upper outlet;

a second means (110) for supplying catalyst connected to the outlet for coked catalyst of said first separation vessel (105) and to the lower inlet of said riser reactor;

a second means (202) for supplying feed located above the lower inlet of said riser reactor;

a second separation vessel (203) for separating used catalyst from a second gas phase connected to said upper outlet of said riser reactor, the second separation vessel (203) comprising a catalyst stripping chamber (212) and having an upper outlet (206) for a gas phase and a lower outlet (7) for used catalyst, said lower outlet being connected to a first regenerator (301).

14. An apparatus according to claim 13, in which the first separation vessel (105) comprises a stripping chamber (111) for stripping catalyst in communication therewith.

15. An apparatus according to claim 13, in which the second riser reactor comprises a supplemental means for supplying catalyst connected to the regenerator and disposed above the feed supply means.

16. An apparatus according to claim 13, in which the second riser reactor comprises a supplemental means for supplying catalyst connected to the regenerator and disposed below the feed supply means.

17. An apparatus according to claim 13, in which means for quenching the gas phase is disposed downstream of the first separation vessel.

18. An apparatus according to claim 13, further comprising a second regenerator (302) which is connected to the first means (101) for supplying regenerated catalyst, in which the first regenerator (301) is disposed below the second regenerator (302) and the first regenerator (301) is connected to the second separation vessel (203, 211).

* * * * *